US012496507B2

(12) United States Patent
Watson

(10) Patent No.: US 12,496,507 B2
(45) Date of Patent: Dec. 16, 2025

(54) GOLF PUTTING AID MAKING TOOL

(71) Applicant: Edward Bates Watson, Dana Point, CA (US)

(72) Inventor: Edward Bates Watson, Dana Point, CA (US)

( * ) Notice: Subject to any disclaimer, the term of this patent is extended or adjusted under 35 U.S.C. 154(b) by 365 days.

(21) Appl. No.: 18/140,433

(22) Filed: Apr. 27, 2023

(65) Prior Publication Data

US 2024/0359078 A1 Oct. 31, 2024

(51) Int. Cl.
*A63B 69/36* (2006.01)
*A63B 71/06* (2006.01)

(52) U.S. Cl.
CPC .. *A63B 69/3688* (2013.01); *A63B 2071/0625* (2013.01); *A63B 2209/08* (2013.01); *A63B 2209/10* (2013.01); *A63B 2225/74* (2020.08)

(58) Field of Classification Search
CPC ..... A63B 69/3688; A63B 2071/0625; A63B 2209/08; A63B 2209/10; A63B 2225/74; A63B 2071/0694
USPC ..... 473/200, 280, 281, 422, 594, 601; 29/281.5, 217, 251, 256, 257, 263, 270, 29/281.1
See application file for complete search history.

(56) References Cited

U.S. PATENT DOCUMENTS 3,357,705 A * 12/1967 Blanchard ..... A63B 43/00 482/109
3,918,720 A * 11/1975 Gordos ..... A63B 69/3688 473/200
4,278,254 A * 7/1981 Simjian ..... A63B 69/3688 473/200
4,411,431 A * 10/1983 Judice ..... A63B 69/3688 473/200
D349,550 S * 8/1994 Reeves ..... D3/254
5,885,165 A * 3/1999 Krause ..... A63B 69/3688 473/200
6,168,061 B1 * 1/2001 Harrison ..... A63B 47/001 224/919
6,193,120 B1 * 2/2001 Chang ..... A63B 57/20 206/315.9
6,832,423 B1 * 12/2004 Villacorta ..... A63B 69/3688 29/257
2007/0241027 A1 * 10/2007 Yang ..... B65D 5/4204 206/580

* cited by examiner

*Primary Examiner* — Nini F Legesse

(57) ABSTRACT

The present disclosure relates to a golf putting aid making tool for assembling and making an ad hoc golf putting aid device. In particular, the golf putting aid making tool may include a retaining member for receiving two golf balls, a connector, and a connector stand coupled to the retaining member and centrally disposed along a lengthwise section of the golf putting aid making tool, where the connector stand receives and supports the connector for coupling the two golf balls along a center portion of the two golf balls.

19 Claims, 20 Drawing Sheets

GOLF PUTTING AID MAKING TOOL

FIELD OF THE INVENTION

The present disclosure relates to a golf putting aid making tool. In particular, but not by way of limitation, the golf putter making tool may include a jig platform having golf ball slots for receiving two golf balls and a connector stand for supporting and aligning a connector by which the two golf balls are permanently or temporally joined.

BACKGROUND

Correct putter alignment is one of many essential parts of mastering golf. To correctly strike the golf ball, the clubface of the golf club must squarely hit the golf ball upon impact. In golf, as in any sport, practice and repetition are necessary in order to become proficient at the game. In golf, mastering the golfer's skill level of their putter stroke can make a difference between winning and losing. To assist golfers with their putting game, many putting training aids are available that allow the golfer a simple yet reliable training devices which provides visual feedback to the golfer on improper golf strokes during putting. For example, these putting training aids include a dual-golf ball putter aid device, a dumb-bell shaped putter aid device, and a cylindrical shaped golf ball. FIG. 1A-FIG. 1E illustrates several inventions describing similar golf putting aids which are also described herein below.

In one instance, U.S. Pat. No. 3,918,720A by Gordos discloses an apparatus for practicing golf ball putting which includes two golf ball members mounted at opposite ends of a rigid connecting rod as demonstrated in FIG. 1A. The length of the rod is such that each of the ball members may be struck simultaneously by the striking face of a putter, and only then will the ball members move forwardly in a straight line.

In another instance, U.S. Pat. No. 5,595,546A by Masters discloses a golf putting aid comprising first and second golf balls connected together in an abutting relationship by a threaded connector that extends into holes formed in the first and second golf balls as demonstrated in FIG. 1B. The first golf ball includes a center formed by a thin wall, an elastic cover wound around the thin wall, a hard cover enclosing the center and elastic cover, wherein the hole formed in the ball extends through the hard cover and terminates adjacent the center. The second golf ball also comprises a center formed by a thin wall, an elastic cover wound around the thin wall, a hard cover enclosing the center and elastic cover, wherein the hole formed in the ball extends through the hard cover and terminates adjacent the center. The threaded connector has first and second threaded ends extending into the holes and urges the first ball to abut the second ball, such that centers of the first and second golf balls are spaced apart a distance less than the length of the face of the putter.

In yet another instance, U.S. Pat. No. 5,885,165A by Krause discloses a putting training apparatus which, when used repeatedly by a golfer, permits him to develop a consistent stroke and accurate putting shot as demonstrated in FIG. 1C. The putting training apparatus includes a pair of balls, preferably regulation golf balls, with a pivotal assembly disposed between the balls which permit relative rotation between the balls. The pivotal assembly is positioned along a common axis which passes through the center of the balls. The pivotal assembly includes a shaft having opposing ends and at least one bearing proximate to each of the opposing ends. A retainer is utilized on each of the ends of the shaft to retain the bearings thereupon.

In still yet another instance, U.S. Pat. No. 6,004,220A by Razzano discloses a putt training device which includes a body having substantially the shape of a cylinder and a moment of inertia about its longitudinal axis substantially as demonstrated in FIG. 1D. The body also has first and second substantially flat ends and a substantially continuous outer surface extending between the first and second ends. The body is adapted to be positioned so that substantially the entire continuous length of the body abuttingly contacts a putting surface during rolling movement of the body on a putting surface to thereby provide a visual indication of which position the face of a golf putting club strikes after contact with the body.

In still yet another instance, U.S. Pat. No. 6,729,969B2 by Fox discloses a golfing aid, the golfing aid includes two partially spherical ends which are formed into an integral body as demonstrated in FIG. 1E. The golfing aid includes two partially spherical ends which are formed into an integral body. An indicator line is created around the circumference of between the two contact points of the golfing aid. The partially spherical ends are formed from golf balls which have had a portion machined off them, leaving a partial golf ball. The two machined balls then have a groove with a chamfered edge cut around the circumference of the cut face. A locating hole is then created by drilling a hole into the cut face of each ball. Glue is applied to the cut surface, and into the locating hole. An internal dowel is then placed into the locating hole. This dowel is barbed, these barbs enabling the dowel to grip into the balls core, and contains an integral indicator ring. The two balls are then attached together to form the integral body of the golfing aid. The indicator ring located in the join between the two golf balls creates an indicator line.

Currently, there are no convenient, portable, ready-to-use, and on-to-go tools that exist which allow the golfer to quickly and reliably make and assemble putter training aids using readily available golf equipment. Therefore, it would be highly advantageous to the golf community to provide them a simple, easy-to-carry, and convenient golf putting aid making tool for converting these readily available golf equipment into ad hoc golf training aid devices.

SUMMARY

Described in the present disclosure is a golf putting aid making tool having a retaining member for receiving two golf balls, a connector, and a connector stand coupled to the retaining member and centrally disposed along a lengthwise section of the golf putting aid making tool, where the connector stand receives and supports the connector for coupling the two golf balls along a center portion of the two golf balls.

In one aspect, the retaining member may include two golf ball recessed slots disposed along a top portion of the retaining member. The connector stand may be disposed between the two golf ball recessed slots which are separated by a gap. Each golf ball recessed slot may be a cut-out of a spherical cap removed from a portion of the retaining member. The connector may include a shaft member coupling a first end cap to a second end cap. The shaft member may be separated into a first shaft section and a second shaft section, where a threaded member is disposed at an exposed end of the first shaft section, and a threaded slot member is disposed at an exposed end of the second shaft section. The first end cap and the second end cap may have magnetic properties. A first golf ball coupling member may applied to an outer side portion of the first end cap and a second golf ball coupling member may be applied to an outer side portion of the second end cap. Each golf ball coupling member may include a substrate having two-sided adhesive properties or a substrate having magnetic properties. The connector stand may include a block member having a stand depression formed along a top portion of the block member. The stand depression may be configured to receive and support a portion of the shaft member of the connector having shape that is complementary to the stand depression.

In another aspect, the golf putting aid making tool may have a slider rail assembly coupled to the retaining member, where the retaining member may include two adjustable sliding members. The slider rail assembly may include two cylindrical rods and a stand support bar extending lengthwise from a first sliding end to a second sliding end. The connector stand may be disposed along a lengthwise center line of the stand support bar. The two adjustable sliding members may be coupled by the slider rail assembly and configured to slide horizontally along a lengthwise section of the slider rail assembly. Each adjustable sliding member may include a pair of holes extending through the adjustable sliding member for receiving the two cylindrical rods when inserted therein. Each adjustable sliding member may include a bar slot extending through the adjustable sliding member for receiving the stand support bar when inserted therein. A golf ball recessed slot may be disposed along an inner side of each adjustable sliding member for holding and retaining the two golf balls when inserted therein.

In yet another aspect, the connector may include a plurality of electrical components integrated into a shaft member of the connector, wherein the plurality of electrical components includes at least an illumination device and an audio device.

In still yet another aspect, the connector and the two golf balls may be assembled into a single unit by the golf putting aid making tool to form an ad hoc golf putting aid device.

These and other objects, features and advantages of the present disclosure will become more apparent in light of the following detailed description of preferred embodiments thereof, as illustrated in the accompanying drawings.

BRIEF DESCRIPTION OF THE DRAWINGS

The present disclosure will be more clearly understood from the following detailed description of the embodiments of the disclosure and from the attached drawings, in which.

In the appended figures, one or more elements may have the same reference numeral in different figures indicating previously described elements.

DETAILED DESCRIPTION

Figure 1A:
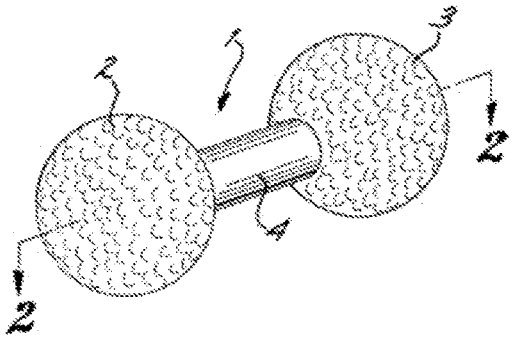
FIG. 1A-FIG. 1E illustrate various types of conventional putter training aid devices, according to an embodiment.
Figure 1B:
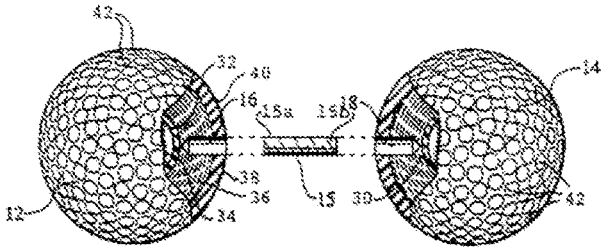
Figure 1C:
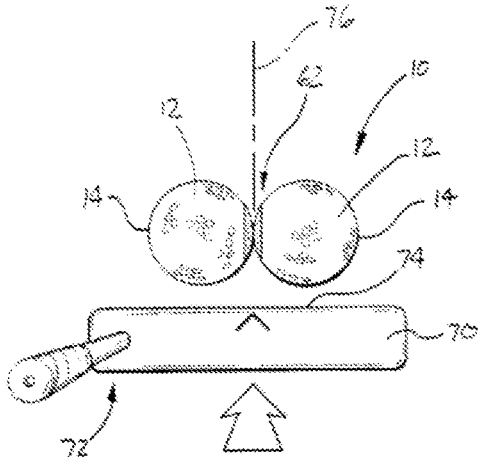
Figure 1D:
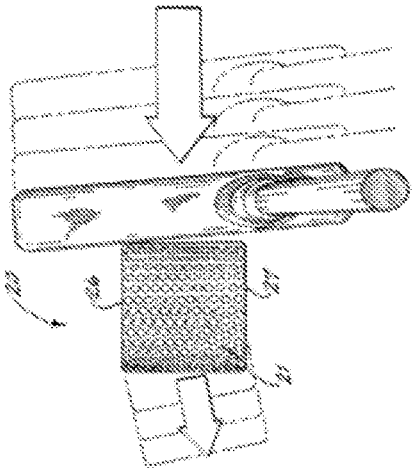
Figure 1E:
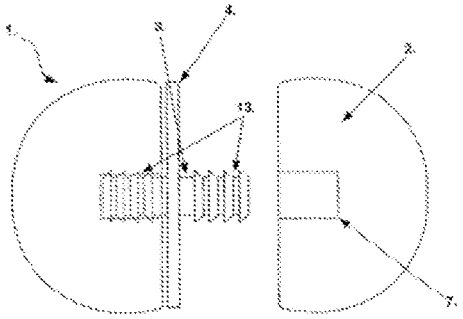
Figure 2:
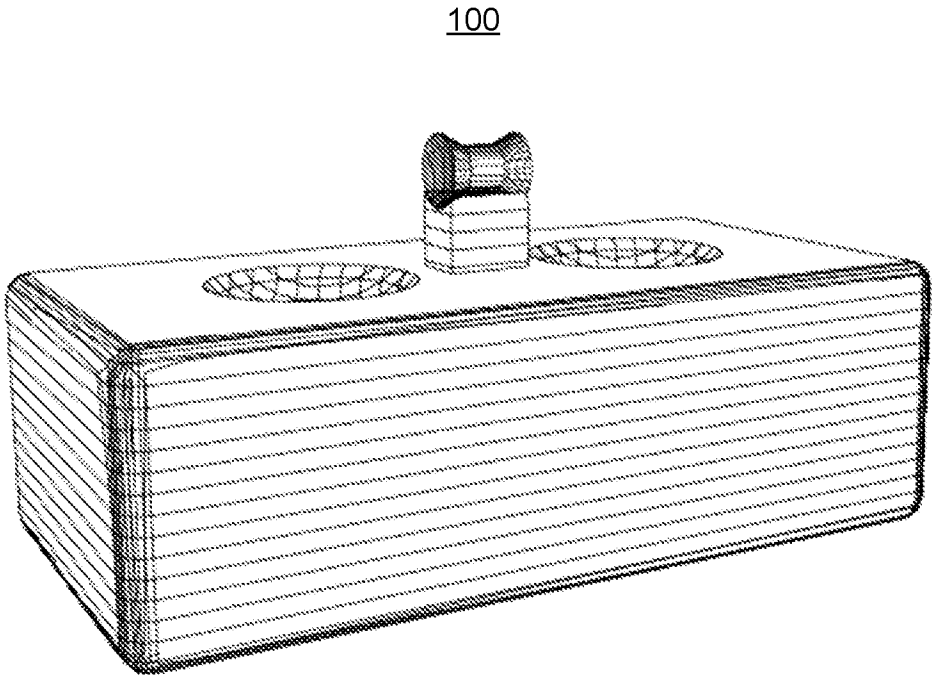
FIG. 2 illustrates a golf putting aid making tool for making a putter alignment device from pairs of golf balls, according to an embodiment.

FIG. 2 illustrates a golf putting aid making tool 100 for making a golf putting aid from two golf balls, according to an embodiment. In one aspect, the golf putting aid making tool 100 is a portable jig for quickly building and manually assembling readily available golf equipment, such as two golf balls, into a putter training aid device. In another aspect, the golf putting aid making tool 100 is compact, lightweight, and portable, being small enough to carry and fit in a golfer's pants, shirt pocket, or golf bag. In yet another aspect, the tool 100 has a simple construction with no moving parts. In addition, the tool 100 is constructed from lightweight, durable, and impact-resistant materials including, but not limited to aluminum, wood, plastics, carbon-reinforced nylon, kevlar-reinforced nylon, fiberglass-reinforced nylon, ABS (acrylonitrile butadiene styrene), PLA (polylactic acid), and TPU (thermoplastic polyurethane).

Figure 3A:
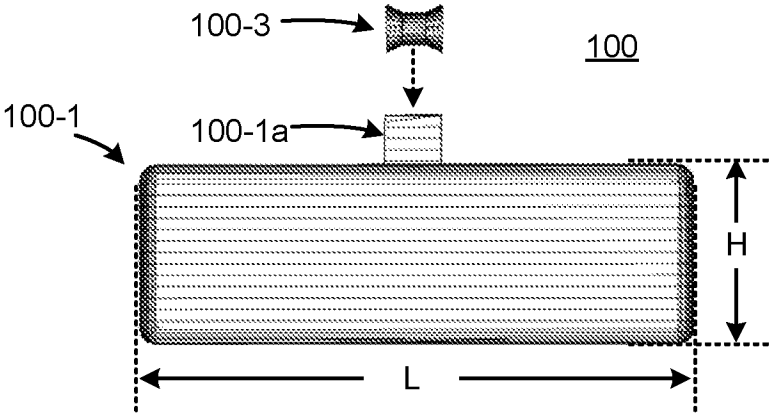
FIG. 3A-FIG. 3D illustrate a side, top, front, and perspective views, respectively, of the golf putting aid making tool, according to an embodiment.
Figure 3B:
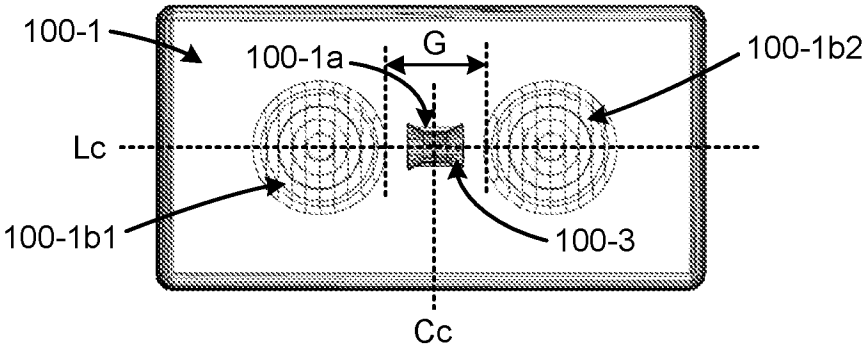
Figure 3C:
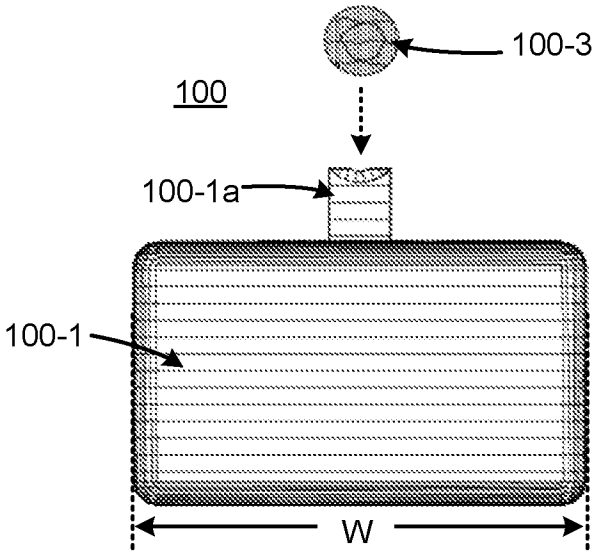

FIG. 3A-FIG. 3D illustrate a side, top, front, and perspective views, respectively, of the golf putting aid making tool 100, according to an embodiment. In one implementation, the golf putting aid making tool 100 includes a retaining member 100-1 having a connector stand 100-1*a* for receiving and holding a connector 100-3 and two golf ball recessed slots (100-*b*1, 100-*b*2) disposed on a top portion of the retaining member 100-1. The connector stand 100-1*a* is centrally positioned along a lengthwise center section (Lc) and a crosswise center (Cc) section of the golf putting aid making tool 100 as shown in FIG. 3B (top view). In addition, connector stand 100-1*a* is disposed between the two golf ball recessed slots (100-*b*1, 100-*b*2) which is separated by a gap (G) along the lengthwise center section (Lc). Dimensionally, the size of the golf putting aid making tool 100 may be, but is not limited to, approximately 4 inches (L)×2 inches (W)×2 inches (H), having a rectangular shaped body. In operation, the connector stand 100-1*a* is configured to receive, align, and hold the connector 100-3 while the two golf ball recessed slots (100-*b*1, 100-*b*2) are formed to receive and hold in place a single golf ball in each slot.

Figure 4:
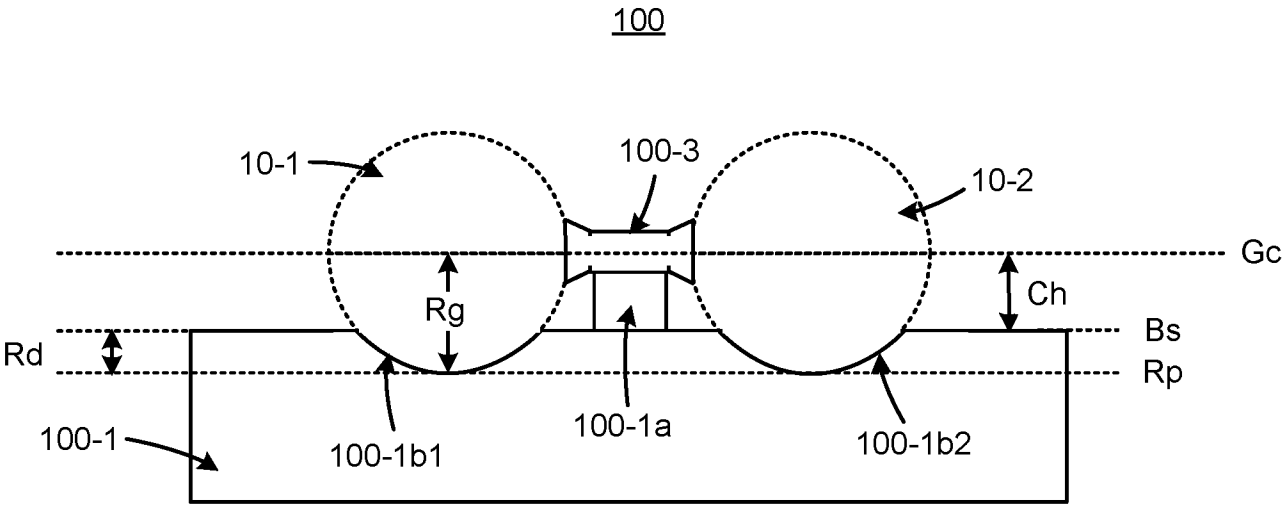
FIG. 4 illustrates a cross-section view of the golf putting aid making tool along the lengthwise center section, according to an embodiment.

FIG. 4 illustrates a cross-section view of the golf putting aid making tool 100 along the lengthwise center section (Lc), according to an embodiment. In one aspect, each golf ball recessed slot (100-*b*1, 100-*b*2) is generally structured as a cut-out of a spherical cap which is removed from the top portion of the retaining member 100-1. A predetermined depth Rd which is the distance between the top portion Bs of the retaining member 100-1 and the lowest point Rp of the golf ball recessed slots (100-*b*1, 100-*b*2) into the retaining member 100-1 is shown in the cross-section view of the tool 100. The predetermined depth Rd is generally the lowest point of the spherical slot cutout into the retaining member 100-1 by which a golf ball (10-1, 10-2) in each slot may rest without rolling out of the slot when inserted therein. In order to properly position the connector 100-3 so it couples the golf balls (10-1, 10-2) along a centerline Gc of each golf ball having a radius Rg, the connector height Ch is determined as follows:

$$Ch = Rg - Rd \quad \text{(Eq. 1)}$$

In addition, the height of the connector stand 100-1*a* and the radius of width of the connector 100-3 may be both adjusted in order to meet the connector height Ch as determined by Eq. 1.

Figure 5B:
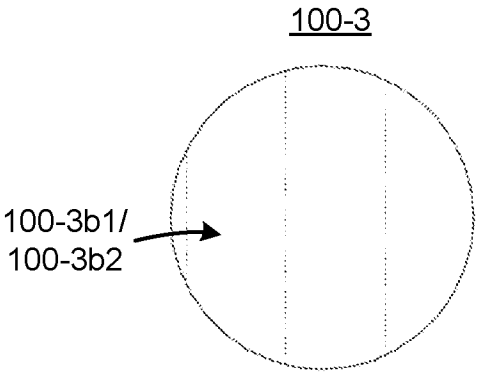
FIG. 5A-FIG. 5C illustrate a side, front, and perspective views of the connector, according to an embodiment.
Figure 5A:
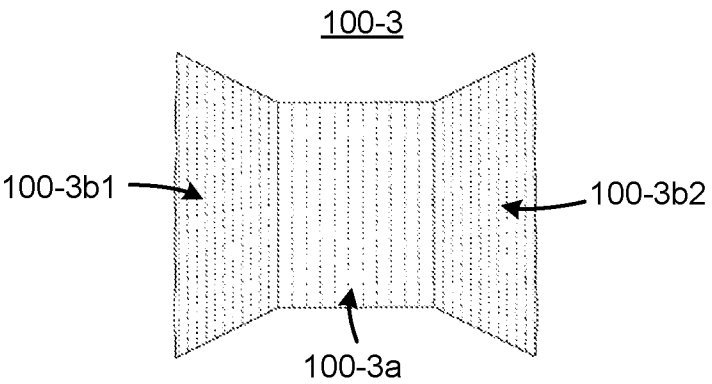
Figure 5C:
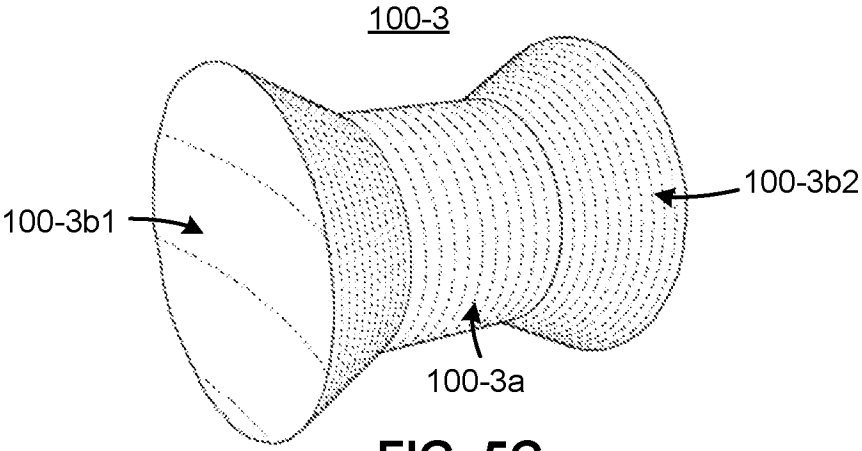

FIG. 5A-FIG. 5C illustrate a side, front, and perspective views of the connector 100-3, according to an embodiment. In one instance, the connector 100-3 may include a shaft member 100-3*a* coupling two end caps (100-3*b*1, 100-3*b*2). The shaft member 100-3*a* includes a cylindrically shaped member such as a rod or barrel having a rigid and inextensible body made from materials such as, but not limited to, plastics, metals, wood, synthetic wood, carbon-fiber, or composite materials. The first end cap 100-3*b*1 is disposed on a first end portion of the shaft member 100-3*a* while the second end cap 100-3*b*2 is disposed on a second end portion of the shaft member 100-3*a*. In addition, each end cap (100-3*b*1, 100-3*b*2) is structured to have a tapered cylinder body that is thin and increasing in diameter from an inner portion of the tapered cylinder body to an outer portion of the tapered cylinder body as shown in FIG. 5A. In another implementation, the connector 100-3, including shaft member 100-3*a* and two end caps (100-3*b*1, 100-3*b*2), may be structured from magnetic components, thereby allowing the connector 100-3 to exhibit magnetic properties for magnetically coupling to golf balls having certain magnetic substrates attached thereon such as, for example, iron, nickel cobalt, or neodymium.

Figure 3D:
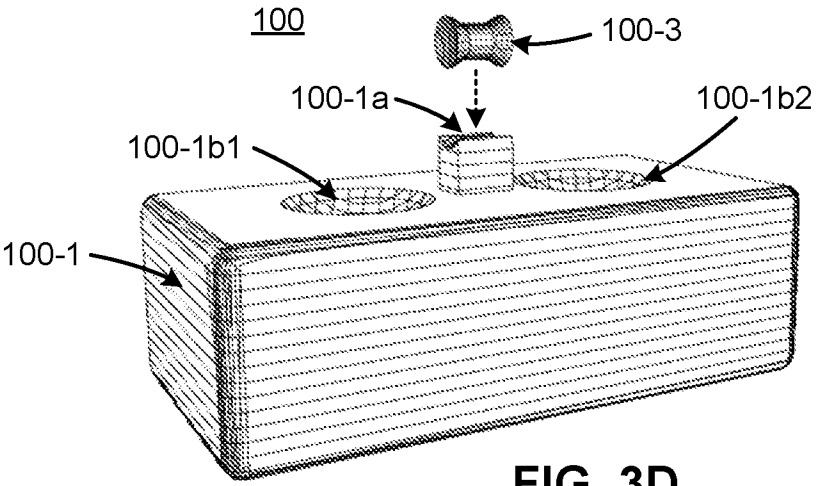
Figure 6A:
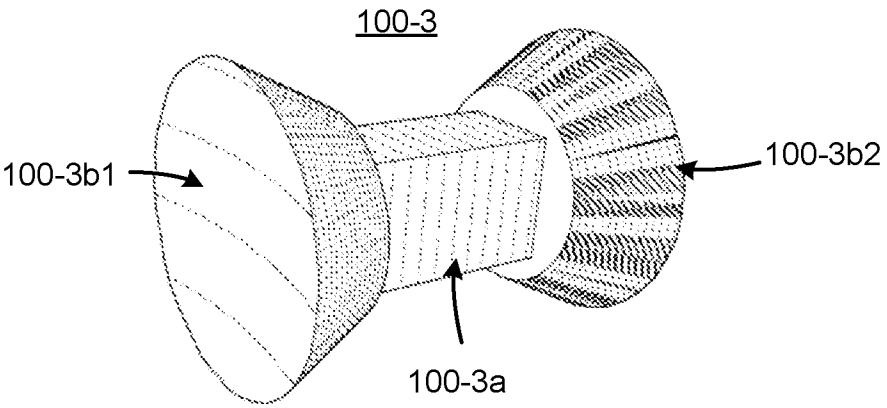
FIG. 6A-FIG. 6D illustrate the connector having various configurations of shaft members, according to an embodiment.
Figure 6B:
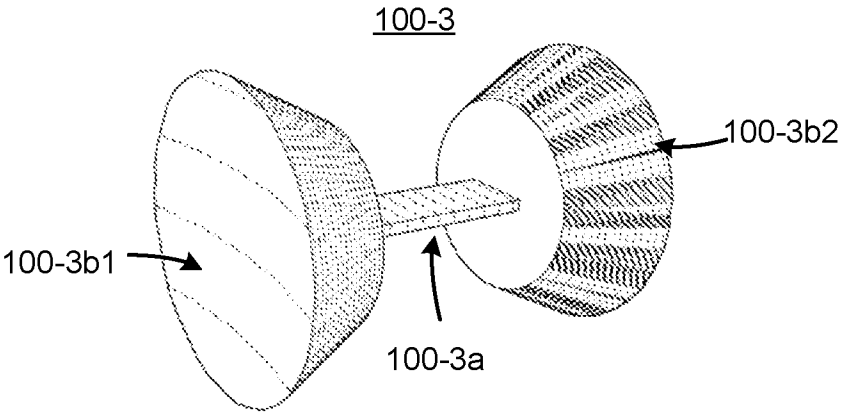
Figure 6C:
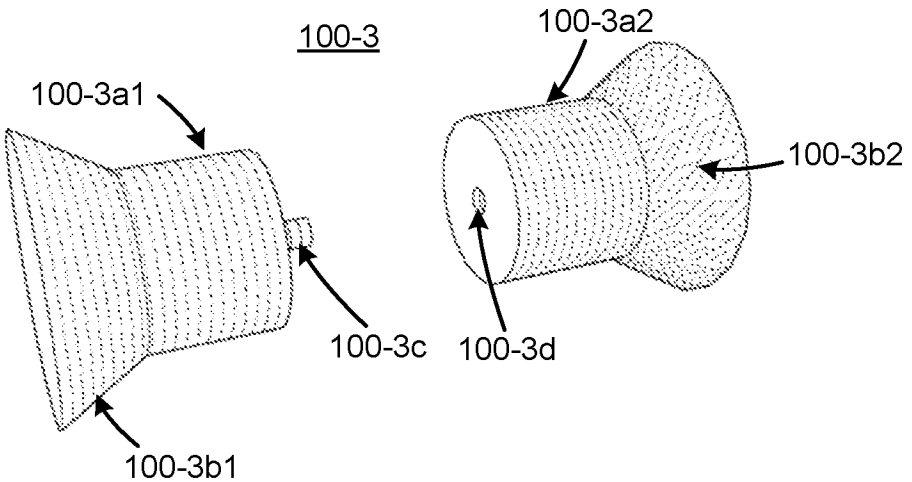
Figure 6D:
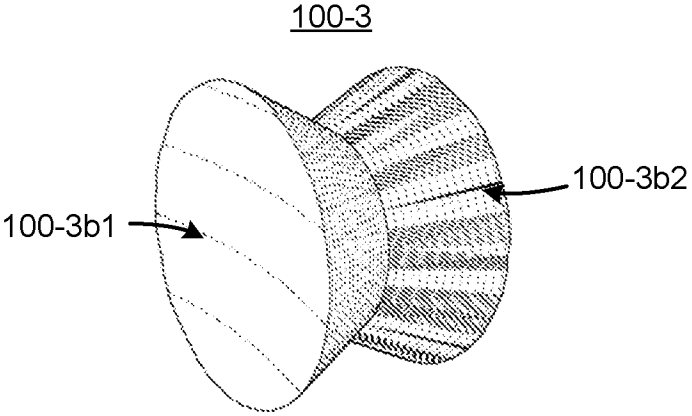

FIG. 6A-FIG. 6D illustrate the connector 100-3 having various configurations of shaft members, according to an embodiment. In one instance, the shaft member 100-3*a* of connector 100-3 may have a shape of a rectangular block as shown in FIG. 6A. In another instance, the shaft member 100-3*a* of connector 100-3 may include a thin bar as shown in FIG. 6B. In yet another instance, the shaft member 100-3*a* of connector 100-3 may be separated into two parts (100-3*a*1, 100-3*a*2) where the first part (100-3*a*1) includes a threaded member 100-3*c* disposed at an exposed end thereon, and the second part (100-3*a*2) includes a threaded slot member 100-3*c* disposed at an exposed end thereon as shown in FIG. 6C. The separated parts (100-3*a*1, 100-3*a*2) of the shaft member 100-3*a* may be coupled and fastened together by mating the threaded member 100-3*c* of the first part (100-3*a*1) to the threaded slot member 100-3*c* of the second part (100-3*a*2). In yet another instance, connector 100-3 may include only the two end caps (100-3*b*1, 100-3*b*2) by connecting both back portions of the two end caps (100-3*b*1, 100-3*b*2) directly with one another, excluding the shaft member 100-3*a*, as shown in FIG. 3D.

Figure 7:
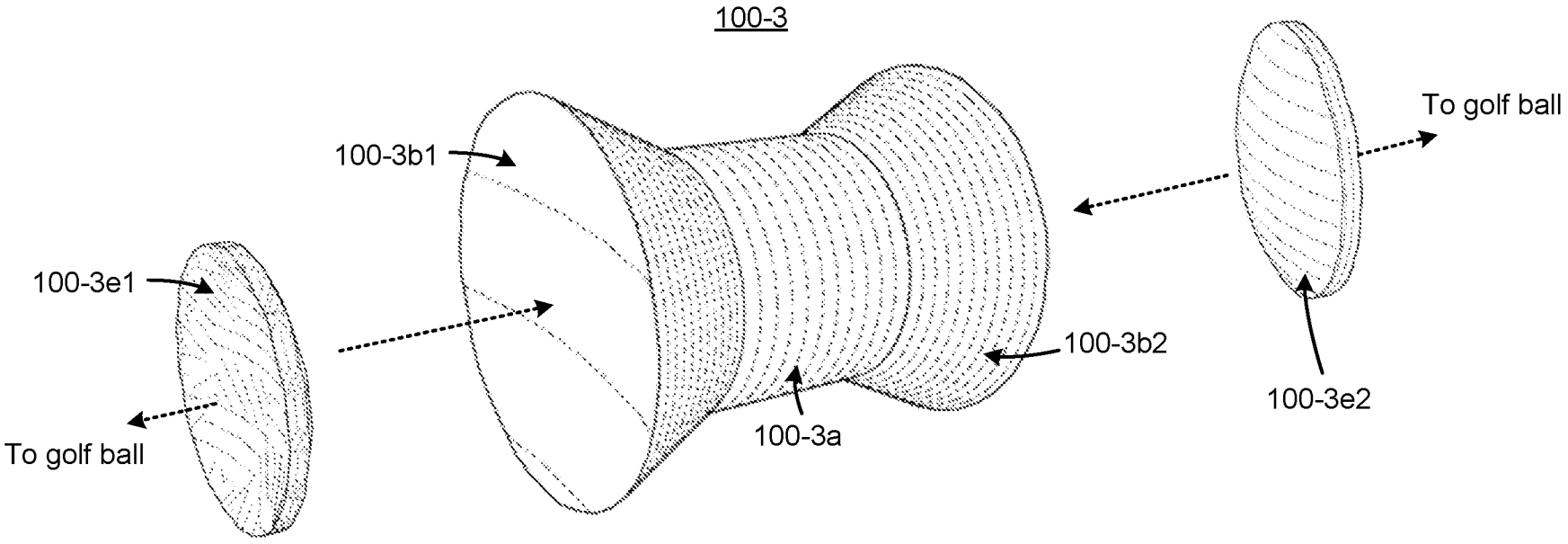
FIG. 7 illustrates golf ball coupling members joining the connector to two golf balls (not shown), according to an embodiment.

FIG. 7 illustrates golf ball coupling members (100-3*e*1, 100-3*e*2) for joining the connector 100-3 to two golf balls (not shown), according to an embodiment. The golf ball coupling members (100-3*e*1, 100-3*e*2) may include two-sided bonding films or substrates having adhesion or magnetic properties. For example, two-sided bonding films or substrates having a first side and a second side may include, but is not limited to, double-side tape, magnetic pad, and liquid, paste, or gel adhesives. In operation, the first side of each golf ball coupling members (100-3*e*1, 100-3*e*2) may be applied and fastened to the two end caps (100-3*b*1, 100-3*b*2), respectively, on each side of the connector 100-3 as shown in FIG. 7. Fastening of the golf ball coupling members (100-3*e*1, 100-3*e*2) to the two end caps (100-3*b*1, 100-3*b*2) may be either permanent or temporal depending on the bonding films or substrates that are applied to the connector 100-3. When the first side applied and attached to the two end caps (100-3*b*1, 100-3*b*2), the second side of the two-sided bonding films or substrates provides a permanent or temporal attachment for receiving a golf ball at each end cap (100-3*b*1, 100-3*b*2).

Figure 8:
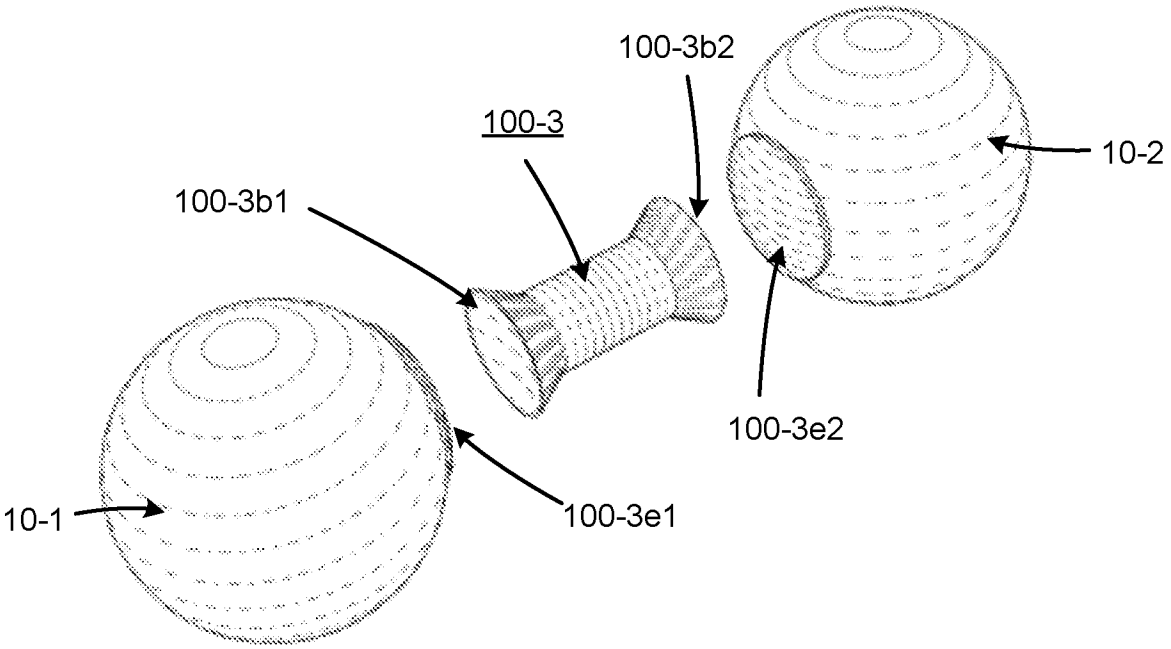
FIG. 8 illustrates coupling members applied to golf balls, respectively, according to an embodiment.
Figure 9B:
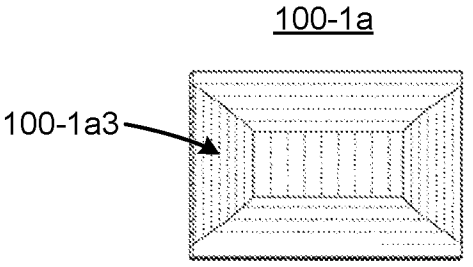
FIG. 9A-FIG. 9D illustrate a top, side, front, and perspective views, respectively, of the connector stand, according to an embodiment.
Figure 9D:
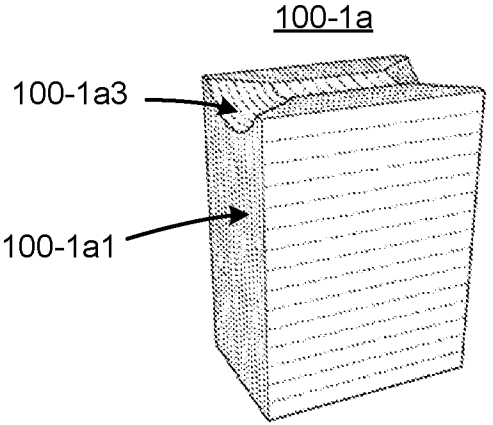
Figure 9A:
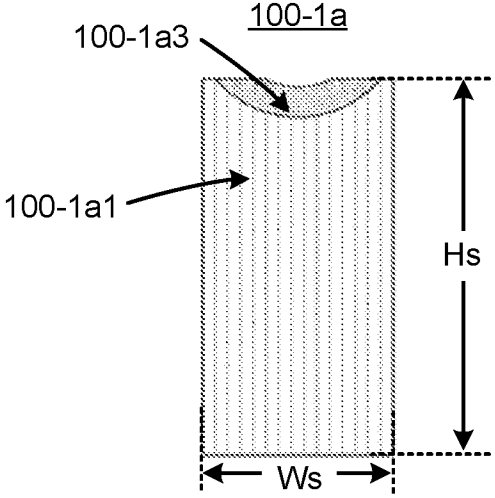
Figure 9C:
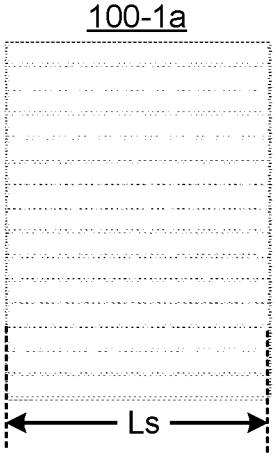

FIG. 8 illustrates coupling members (100-3*e*1, 100-3*e*2) applied to golf balls (10-1, 10-2), respectively, according to an embodiment. In one instance, the first side of each coupling members (100-3*e*1, 100-3*e*2) may be applied and attached to a golf ball (10-1, 10-2) before attaching the second side of each coupling members (100-3*e*1, 100-3*e*2) to the connector 100-3 via the two-sided bonding films or substrates. In another instance, the first side of each coupling members (100-3*e*1, 100-3*e*2) may be applied and attached to the end caps of the connector 100-3 before attaching a golf ball (10-1, 10-2) the second side of each coupling members (100-3*e*1, 100-3*e*2) via the two-sided bonding films or substrates.

FIG. 9A-FIG. 9D illustrate a top, side, front, and perspective views, respectively, of the connector stand 100-1*a*, according to an embodiment. In one aspect, the connector stand 100-1*a* includes a block member 100-1*a*1 having a stand depression 100-1*a*3 formed along a top portion of the block member 100-1*a*1. In another aspect, the stand depression 100-1*a*3 is structured to receive and support the shaft member portion 100-3*a* of the connector 100-3 having shape that is complementary to the stand depression 100-1*a*3. Dimensionally, the block member 100-1*a*1 has an approximate size of 20 mm (Ls)×12 mm (Ws)×12 mm (Hs) but can also vary in size depending on requirements of the connector height Ch as previously discussed hereinabove. The stand depression 100-1*a*3 may have a shape of an inward curvature, as shown in FIG. 5A, for receiving connectors 100-3 with a cylindrically shaped shaft member portion 100-3*a*. In other implementations, the stand depression 100-1*a*3 may include, but is not limited to, other slot shapes (rectangular-slots, v-slots, etc.) for receiving complementary shaped shaft member portion 100-3*a* of the connectors 100-3 (e.g., block-shapes, triangular shapes, etc.) having similar dimensions.

Figure 10:
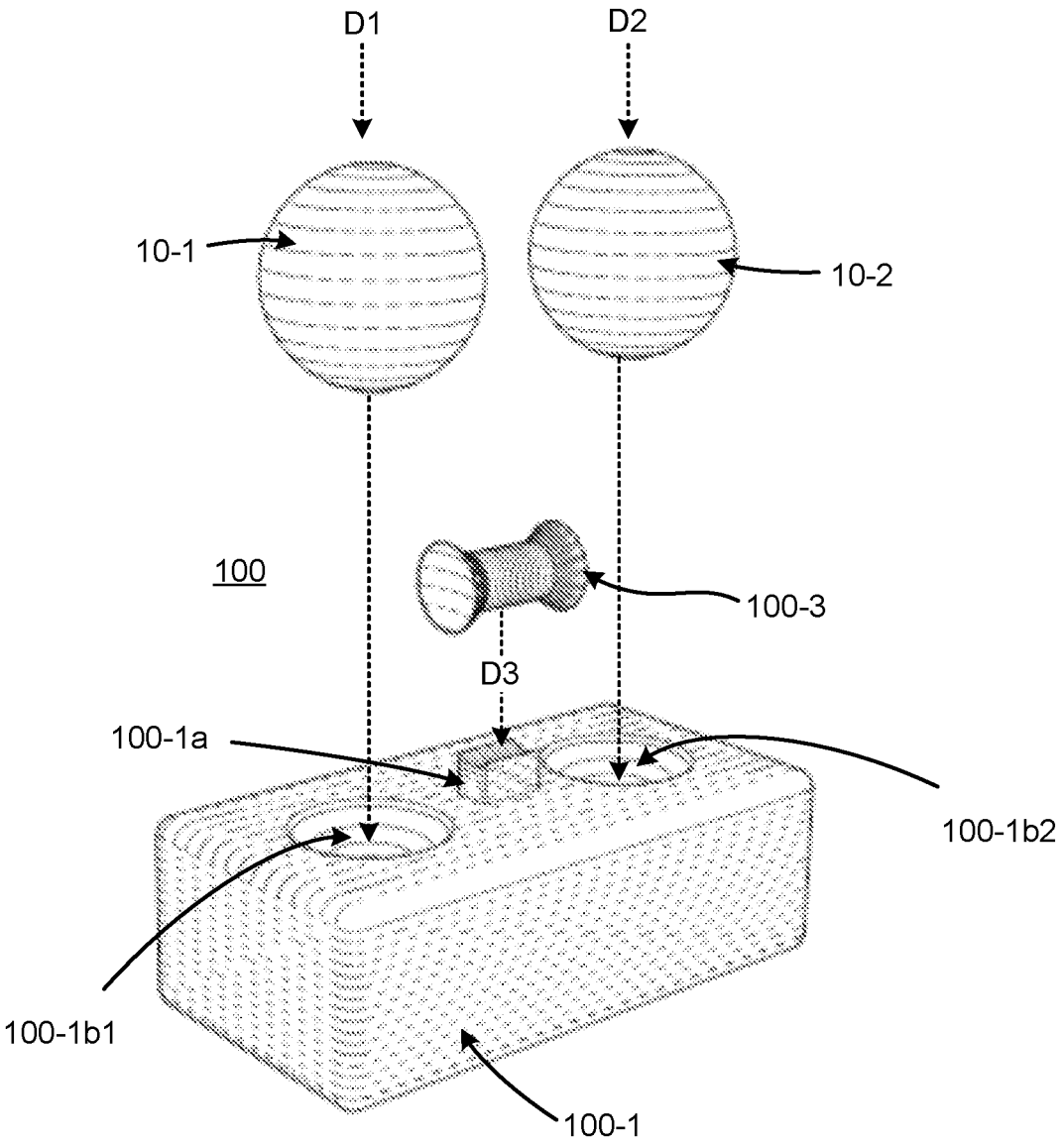
FIG. 10 illustrates pre-assembled components of a golf putting aid with the golf putting aid making tool, according to an embodiment.

FIG. 10 illustrates pre-assembled components of a golf putting aid with the golf putting aid making tool 100, according to an embodiment. Prior to manually assembling the golf putting aid by a golfer, the first golf ball 10-1 may be positioned above the first golf ball recessed slot (100-*b*1) along a vertical direction D1 for insertion, the second golf ball 10-2 may be positioned above the second recessed slot (100-*b*2) along a vertical direction D2 for insertion, and the connector 100-3 may be positioned above the connector stand 100-1*a* along a vertical direction D3 for placement on the connector stand 100-1*a* in between the golf balls (10-1, 10-2).

Figure 11:
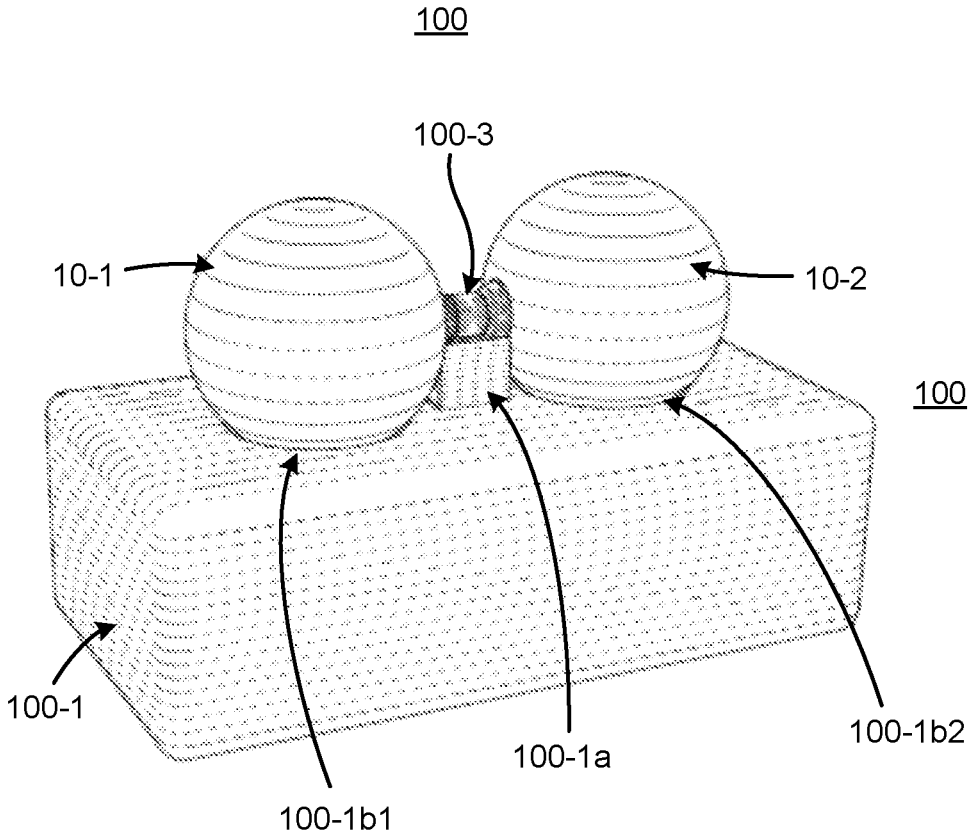
FIG. 11 illustrates the golf putting aid as assembled using the golf putting aid making tool, according to an embodiment.

FIG. 11 illustrates the golf putting aid as assembled using the golf putting aid making tool 100, according to an embodiment. At assembly, the first golf ball 10-1 is inserted into recessed slot 100-*b*1, the second golf ball 10-2 is inserted in the second recessed slot 100-*b*2, and the connector 100-3 is placed on the connector stand 100-1*a* coupling the golf balls (10-1, 10-2) via coupling members (100-3*e*1, 100-3*e*2) which may include two-sided bonding films or substrates having adhesion or attractive properties as described in previous embodiments.

Figure 12:
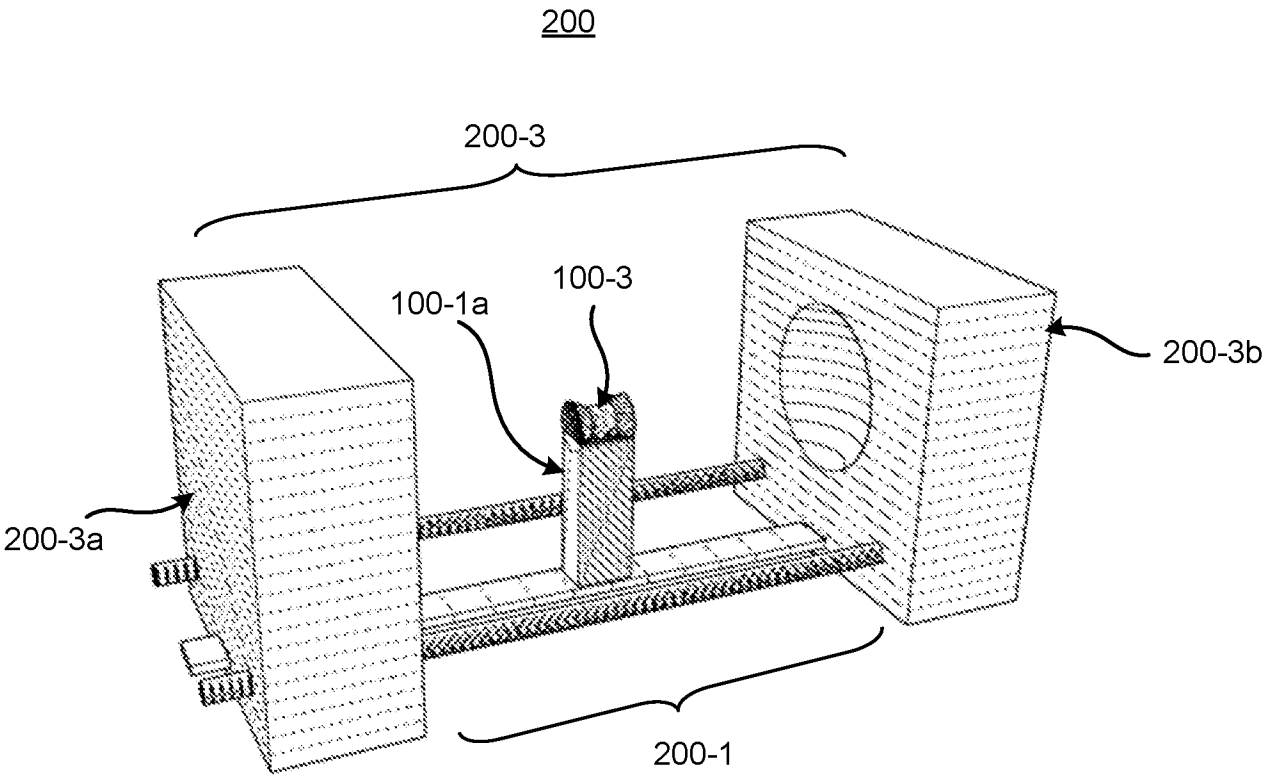
FIG. 12 illustrates a golf putting aid making tool having a slider rail assembly, according to an embodiment.
Figure 13B:
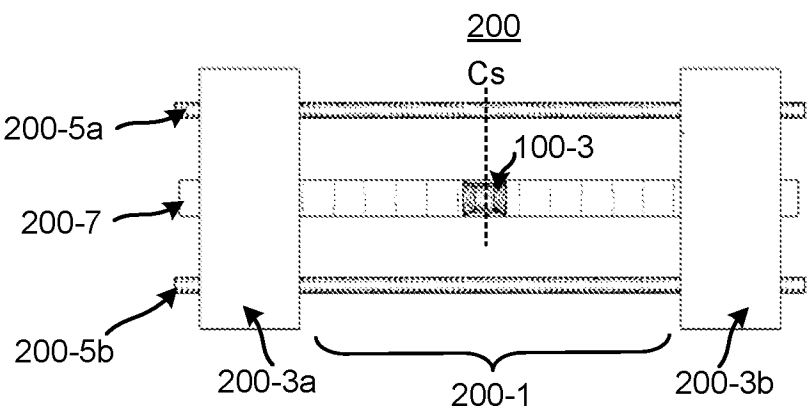
FIG. 13A-FIG. 13D illustrate a side, top, front, and perspective views, respectively, of a golf putting aid making tool having a slider rail assembly, according to an embodiment.
Figure 13D:
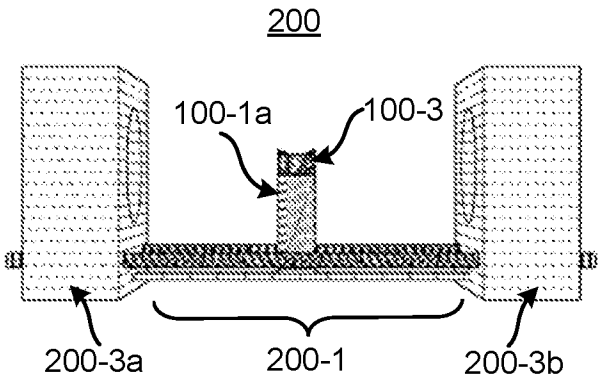
Figure 13A:
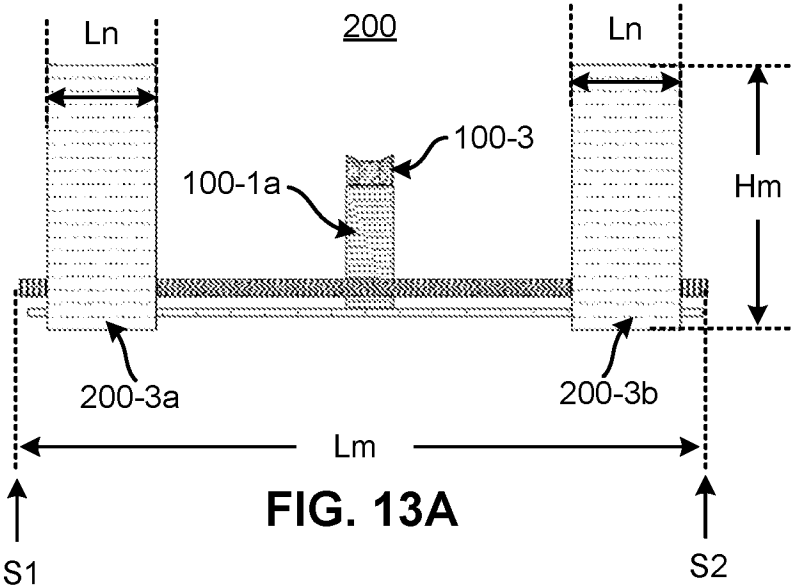
Figure 13C:
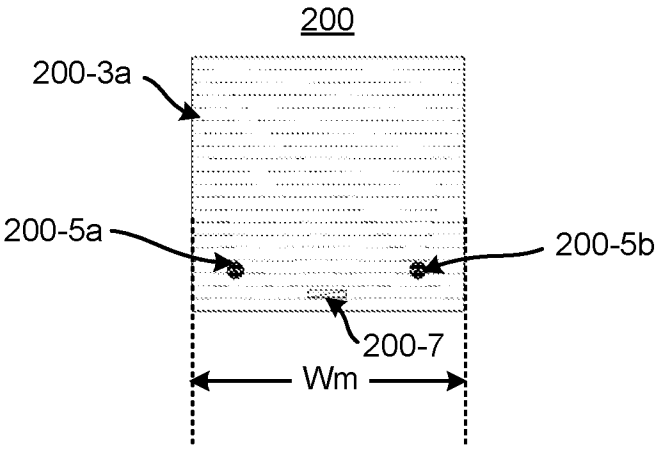

FIG. 12 illustrates a golf putting aid making tool 200 having a slider rail assembly, according to an embodiment. In one aspect, the golf putting aid making tool 200 share similar components with the previous tool 100 including the connector stand 100-1*a* and the connector 100-3, both having the same function and purpose as in the previous tool 100. In addition, the golf putting aid making tool 200 is similar in size to the previous tool 100, having a compact, lightweight, and portable body which is small enough to carry and fit in a golfer's pants or shirt pocket. Unlike the previous tool 100, the golf putting aid making tool 200 includes additional components such as a slider rail assembly 200-1 coupled to a retaining member 200-3 having adjustable sliding members (200-3*a*, 200-3*b*) for making and assembling the putting training aid device. These components may be constructed from lightweight, durable, and impact-resistant materials including, but not limited to aluminum, wood, plastics, carbon-reinforced nylon, kevlar-reinforced nylon, fiberglass-reinforced nylon, ABS (acrylonitrile butadiene styrene), PLA (polylactic acid), and TPU (thermoplastic polyurethane).

FIG. 13A-FIG. 13D illustrate a side, top, front, and perspective views, respectively, of a golf putting aid making tool 200 having a slider rail assembly 200-1, according to an embodiment. The slider rail assembly 200-1 may include two cylindrical rods (200-5*a*, 200-5*b*) and a stand support bar 200-7 extending lengthwise from a first sliding end S1 to a second sliding end S2. Adjustable sliding members (200-3*a*, 200-3*b*) are coupled by slider rail assembly 200-1 and configured to slide horizontally along a lengthwise section of the slider rail assembly 200-1. The connector stand 100-1*a* is disposed on and along a lengthwise center line Cs of the stand support bar 200-7, and configured to receive and vertically support the connector 100-3. Accordingly, the connector stand 100-1*a* is centrally disposed along a lengthwise section Lm of the golf putting aid making tool golf putting aid making tool 200.

Figure 14:
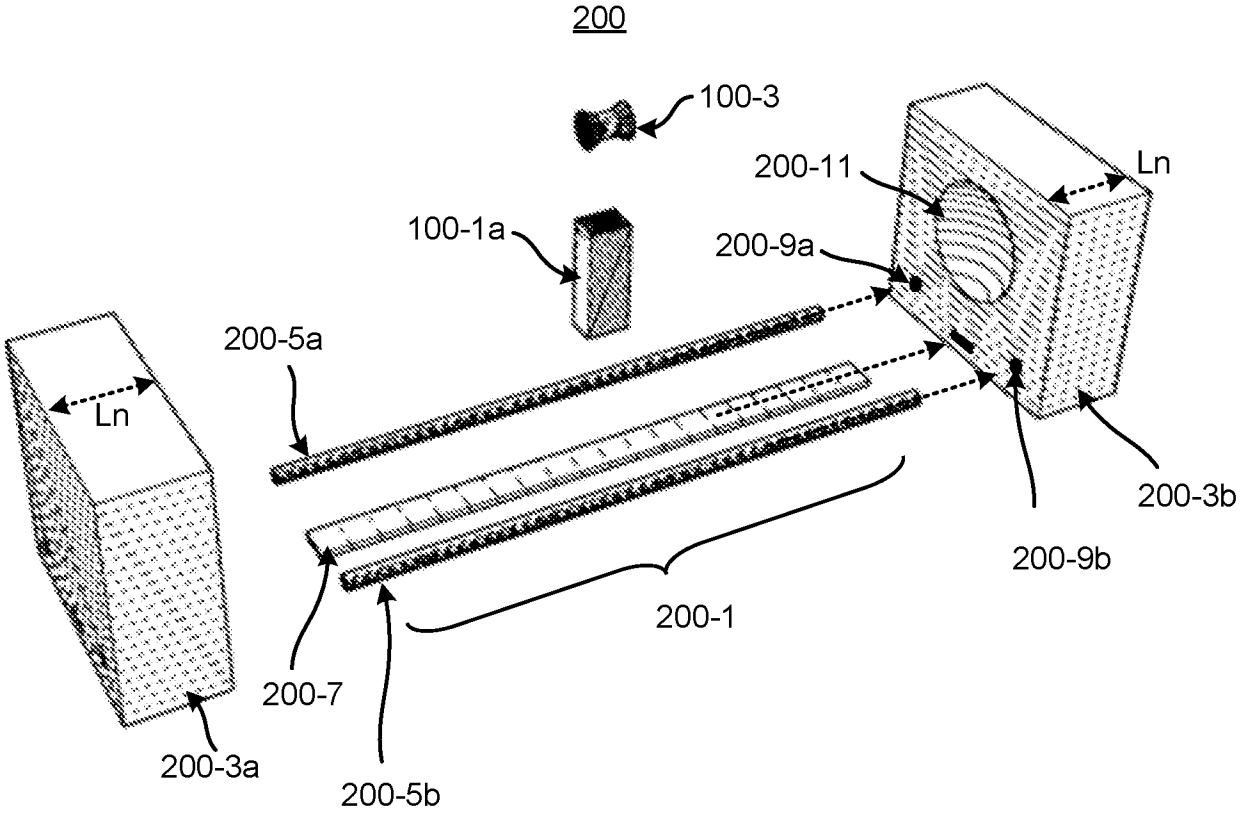
FIG. 14 illustrates an exploded view of the golf putting aid making tool with the slider assembly, according to an embodiment.

Dimensionally, the size of the golf putting aid making tool 200 may be, but is not limited to, approximately 4 inches (Lm)×2 inches (Wm)×2 inches (Hm), having a rectangular shaped area of operation. In addition, the dimensions of each adjustable sliding member (200-3*a*, 200-3*b*) may be, but is not limited to, approximately 2 inches (Ln)×2 inches (Wm)×2 inches (Hm), FIG. 14 illustrates an exploded view of the golf putting aid making tool 200 with the slider assembly, according to an embodiment. In the exploded view, an inner side of one of the adjustable sliding member (200-3*b*) is revealed showing features disposed therein. These inner features are applicable to both adjustable sliding members (200-3*a*, 200-3*b*) being formed as a mirror image of one another. In one instance, each adjustable sliding member may have a pair of holes (200-9*a*, 200-9*b*) extending through the length (Ln) of the adjustable sliding member for receiving the two cylindrical rods (200-5*a*, 200-5*b*) when inserted therein. In addition, each adjustable sliding member may include a bar slot (200-7) extending through the length (Ln) of the adjustable sliding member for receiving the stand support bar 200-7 when inserted therein. Furthermore, each adjustable sliding member (200-3*a*, 200-3*b*) may have a golf ball recessed slot (200-11) disposed along the inner side of each adjustable sliding member for holding and retaining the golf ball (not shown) in set position when inserted therein.

Figure 15A:
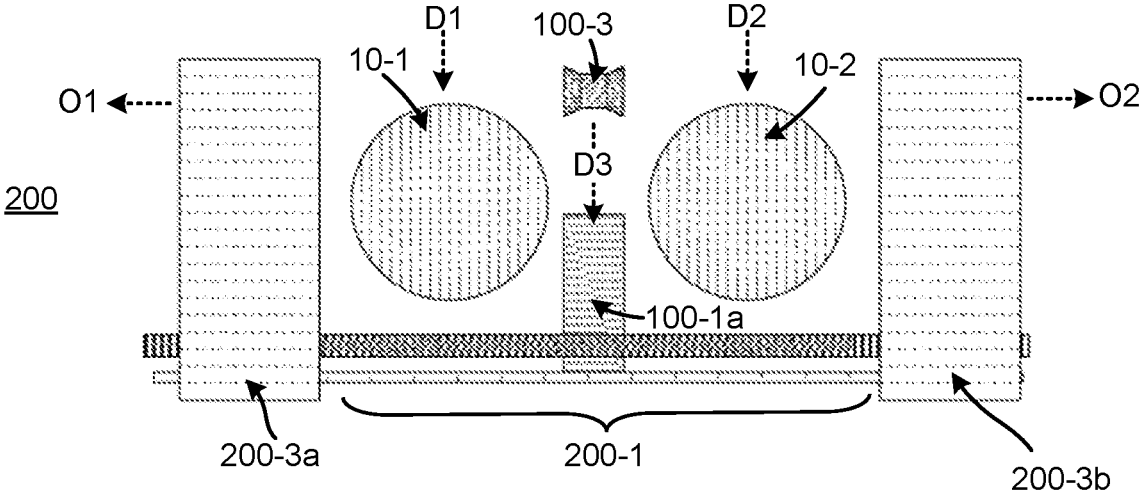
FIG. 15A-FIG. 15C illustrate a general use of the golf putting aid making tool for constructing and assembling a golf putting aid, according to an embodiment.
Figure 15B:
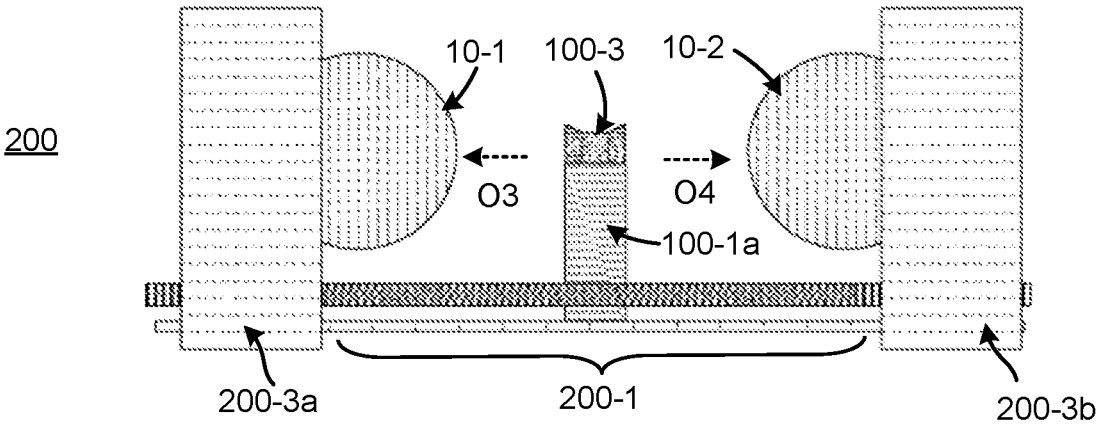
Figure 15C:
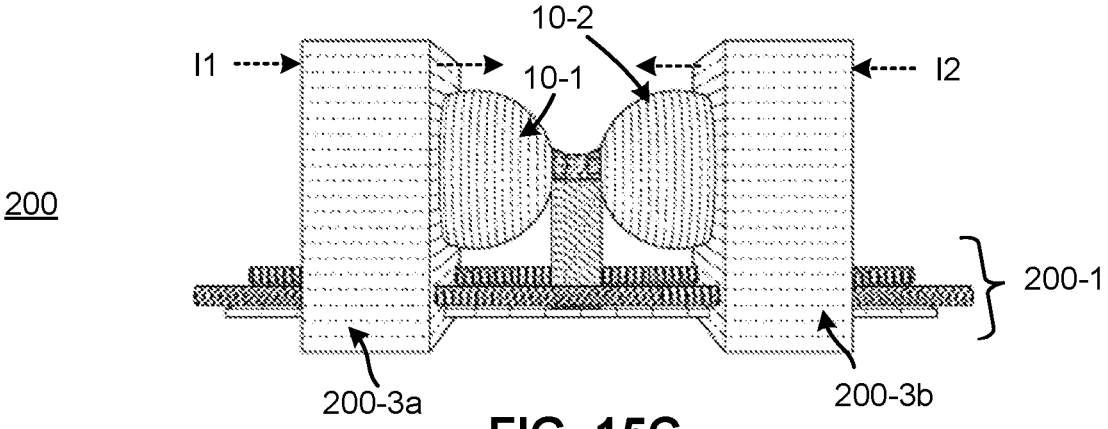

FIG. 15A-FIG. 15C illustrate a general use of the golf putting aid making tool 200 for constructing and assembling a golf putting aid, according to an embodiment. First, the adjustable sliding members (200-3*a*, 200-3*b*) are moved to its most outer position (O1, O2) by horizontally sliding each slider along the slider rail assembly 200-1 away from connector stand 100-1*a*, as shown in FIG. 15A. Next, a first golf ball 10-1 is inserted in an opening D1 between the connector stand 100-1*a* and the first adjustable sliding member 200-3*a*, while a second golf ball 10-2 is inserted in an opening D1 between the connector stand 100-1*a* and the second adjustable sliding member 200-3*b*. At a third step, the connector 100-3 is placed on the connector stand 100-1*a* in an opening D3 between the two golf balls (10-1, 10-2). FIG. 15B illustrates the connector 100-3 disposed on the connector stand 100-1*a* after completing the previous step. Next, the first golf ball 10-1 is inserted along an outward direction O3 towards the golf ball recessed slot (200-11) of the first adjustable sliding member 200-3*a*, while the second golf ball 10-2 inserted along an outward direction O4 towards the golf ball recessed slot (200-11) of the second adjustable sliding member 200-3*b*. Finally, the adjustable sliding members (200-3*a*, 200-3*b*) are moved to its most inward position (I1, I2) by horizontally sliding each slider along the slider rail assembly 200-1 towards the connector stand 100-1*a*, thereby causing the golf balls (10-1, 10-2) to make contact and fasten to the connector 100-3 via coupling members, as shown in FIG. 15C.

Figure 16:
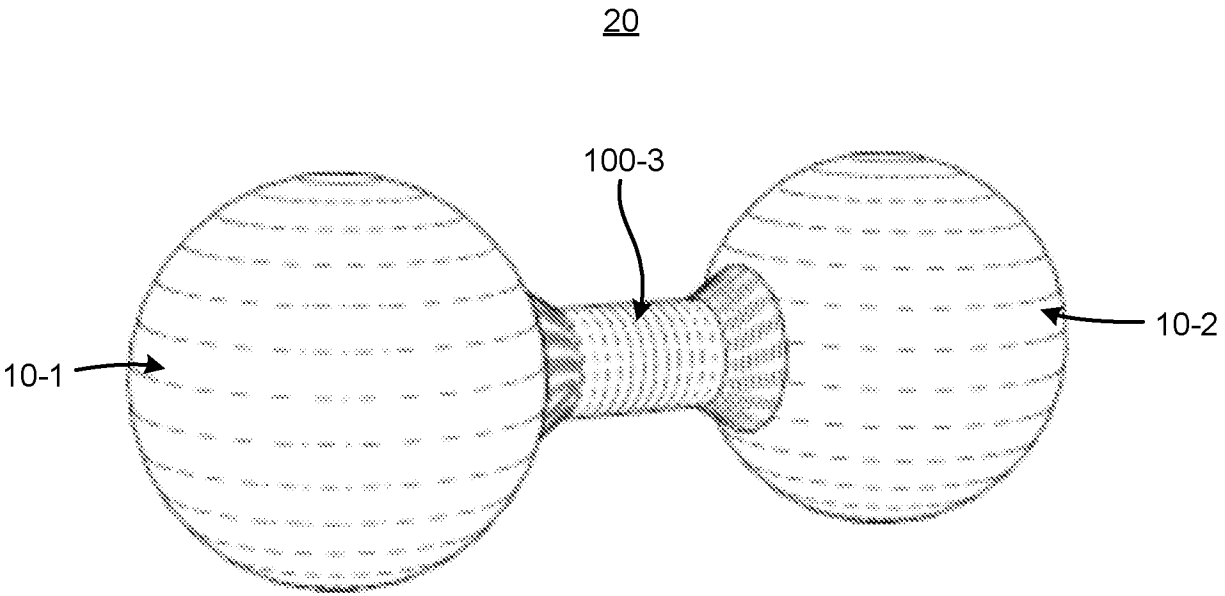
FIG. 16 illustrates an ad hoc golf putting aid device made by the golf putting aid making tool with two golf balls, according to an embodiment.

FIG. 16 illustrates an ad hoc golf putting aid device 20 made by the golf putting aid making tool (100 or 200) with two golf balls (10-1, 10-2), according to an embodiment. The golf putting aid making tool 100 provides many advantages for the golfer including, but not limited to, 1) making and assembling multiple putting training aid 20 with existing golf equipment (i.e., golf balls); 2) perfectly aligning the center of the connector 100-3 to the center of each golf ball; 3) allowing the golfer to quickly assemble putting training aids made for practicing their putter swing at any site (e.g., golf course, training facility, or at home).

Figure 17A:
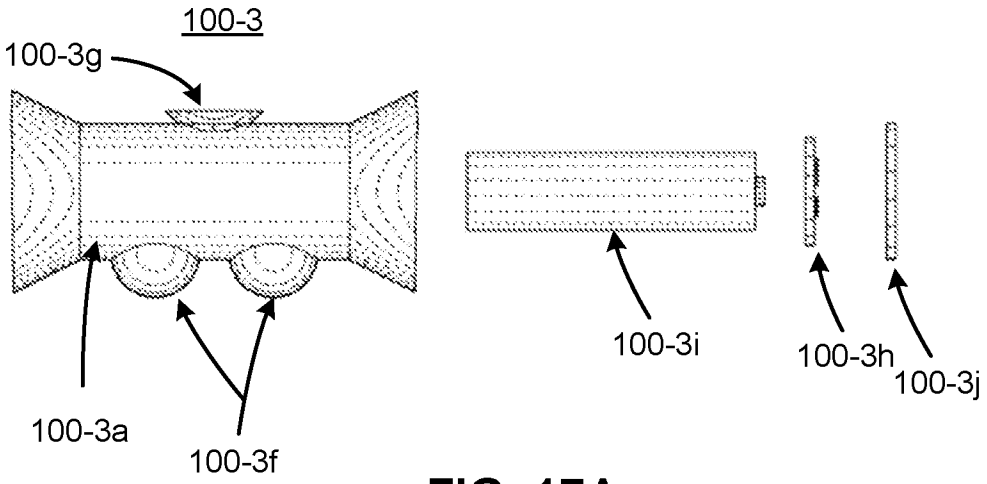
FIG. 17A-FIG. 17B illustrate exploded views (side and perspective) of the connector having built-in enhanced visual and audio features, according to an embodiment.
Figure 17B:
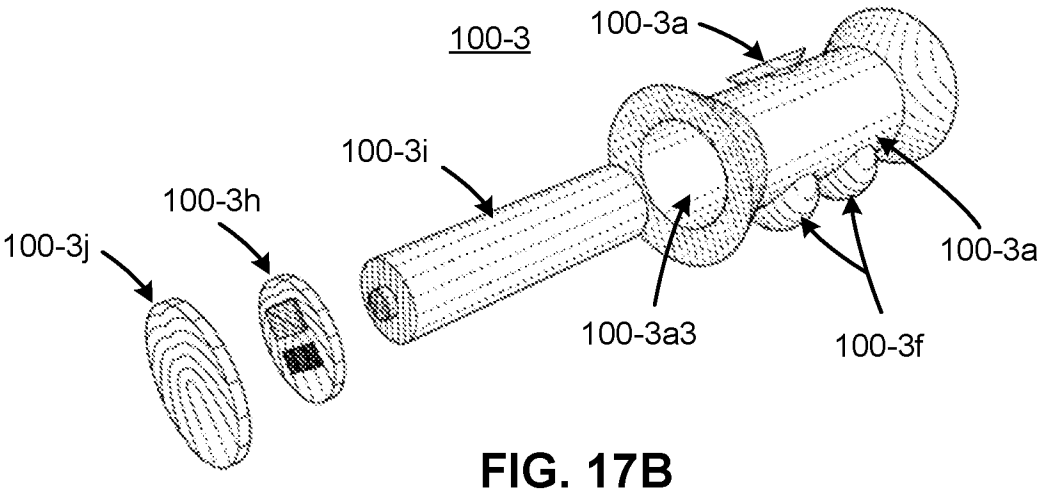

FIG. 17A-FIG. 17B illustrate exploded views (side and perspective) of the connector 100-3 having built-in enhanced visual and audio features, according to an embodiment. As previously described hereinabove, the connector 100-3 may have many design configurations providing structural integrity and durability when making the putting training aid. In addition to these designs, the connector 100-3 may also include functional features which provide visual and audio feedback to the golfer when the putting training aid is fully assembled by the golf putting aid making tool (100 or 200). In one aspect, the connector 100-3 may include integrated electrical components disposed along the shaft member 100-3*a* of the connector 100-3. These integrated electrical components may include one or more illumination devices 100-3*f*, a speaker 100-3*g*, printed circuit board 100-3*h*, and battery 100-3*i*. The shaft member 100-3*a* may have a hollow interior 100-3*a*3 for internally housing the integrated electrical components. In addition, shaft member 100-3*a* may also include a removable cover member 100-3*j* for accessing and enclosing electrical contents in the hollow interior 100-3*a*3 of the shaft member 100-3*a*. In one instance, the illumination device 100-3*f* may include two light emitting diodes (LEDs) having different color emissions. In another instance, the illumination device 100-3*f* may include a single multi-chip LED which can produce millions of colors.

Figure 18:
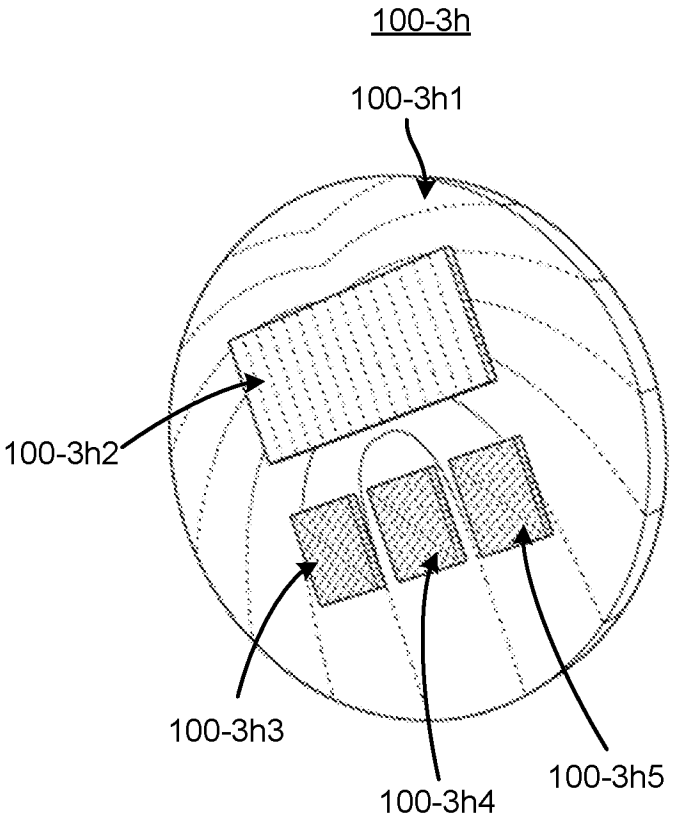
FIG. 18 illustrates the printed circuit board for controlling the visual and audio components of the connector with enhanced built-in features, according to an embodiment.
Figure 19B:
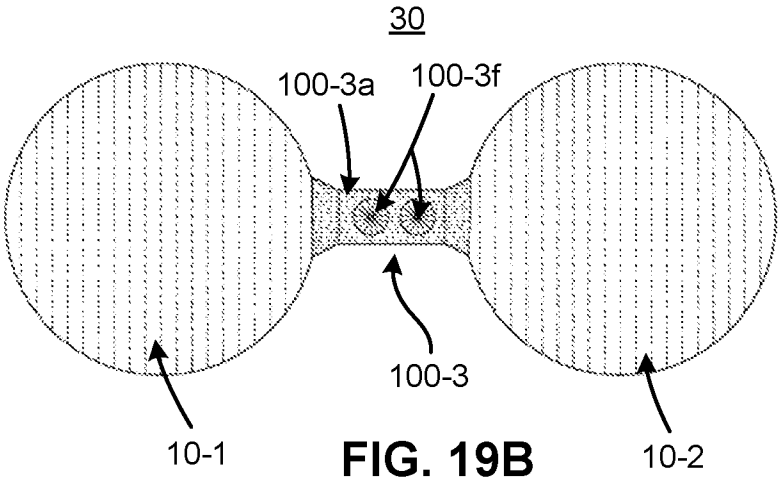
FIG. 19A-FIG. 19D illustrate an enhanced golf putting aid device with the two golf balls coupled by the connector having built-in enhanced visual and audio features, according to an embodiment.
Figure 19A:
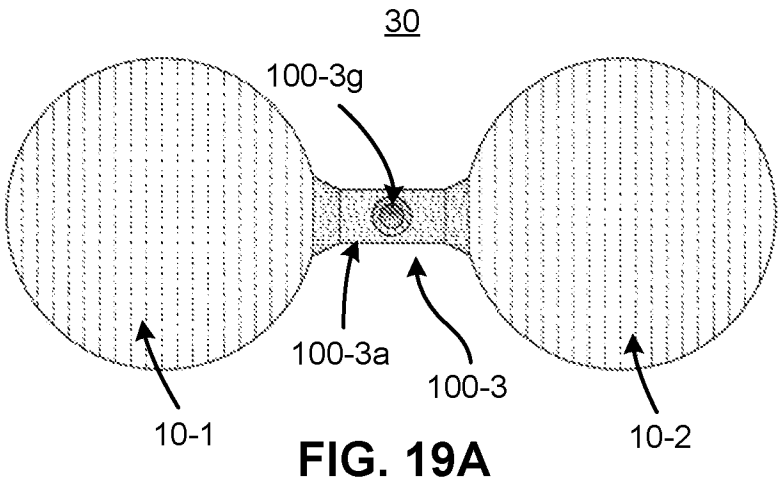
Figure 19D:
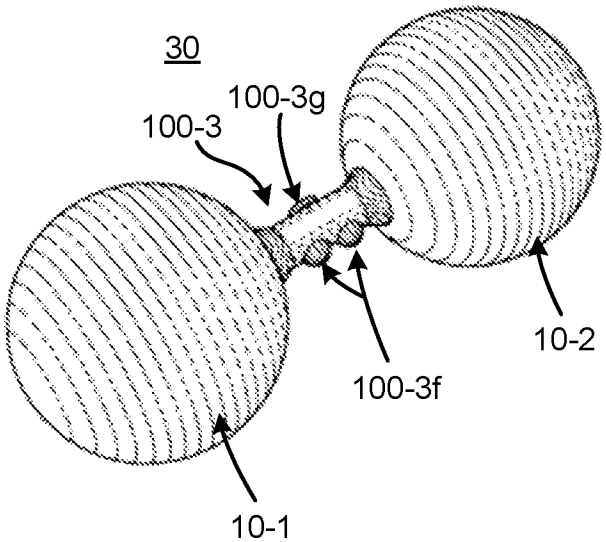
Figure 19C:
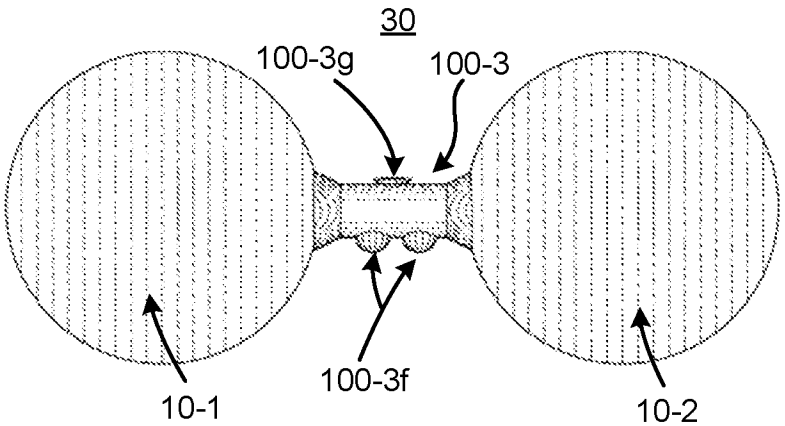

FIG. 18 illustrates the printed circuit board 100-3*h* for controlling the visual and audio components of the connector 100-3 with enhanced built-in features, according to an embodiment. The printed circuit board 100-3*h* may include a substrate with circuitry 100-3*h*1, a microprocessor or microcontroller 100-3*h*2, illumination driver 100-3*h*3, audio driver 100-3*h*4, and an accelerometer chip 100-3*h*5. In operation, the accelerometer chip 100-3*h*5 detects and measures dynamic acceleration caused by movement, rotation, impact, or vibration, allowing it to determine the angle of deviation of the measured object from the vertical plane. In application, movement data detected by the accelerometer chip 100-3*h*5 may be transmitted to the microprocessor 100-3*h*2 which processes the detected movement data and determines a response based on an algorithm and predetermined set of instructions. Movement data may include information which characterizes impact, rotation, or linear movement of the shaft member 100-3*a* when applied to the putting training aid. Depending on the type of movement data received, the microprocessor 100-3*h*2 transmits a signal to the illumination driver 100-3*h*3 and/or the audio driver 100-3*h*4 triggering a response which activates the one or more illumination devices 100-3*f* and/or a speaker 100-3*g*.

FIG. 19A-FIG. 19D illustrate an enhanced putting training aid device 30 with the two golf balls (10-1, 10-2) coupled by the connector 100-3 having built-in enhanced visual and audio features, according to an embodiment. In one instance, the two golf balls (10-1, 10-2) are attached to the connector 100-3 via coupling members (100-3*e*1, 100-3*e*2) which may include two-sided bonding films or substrates having adhesion or attractive properties as described in previous embodiments. In another instance, principles of making and assembling the putting training aid 30 may be accomplished via the golf putting aid making tool (100 or 200) as described hereinabove.

Figure 20:
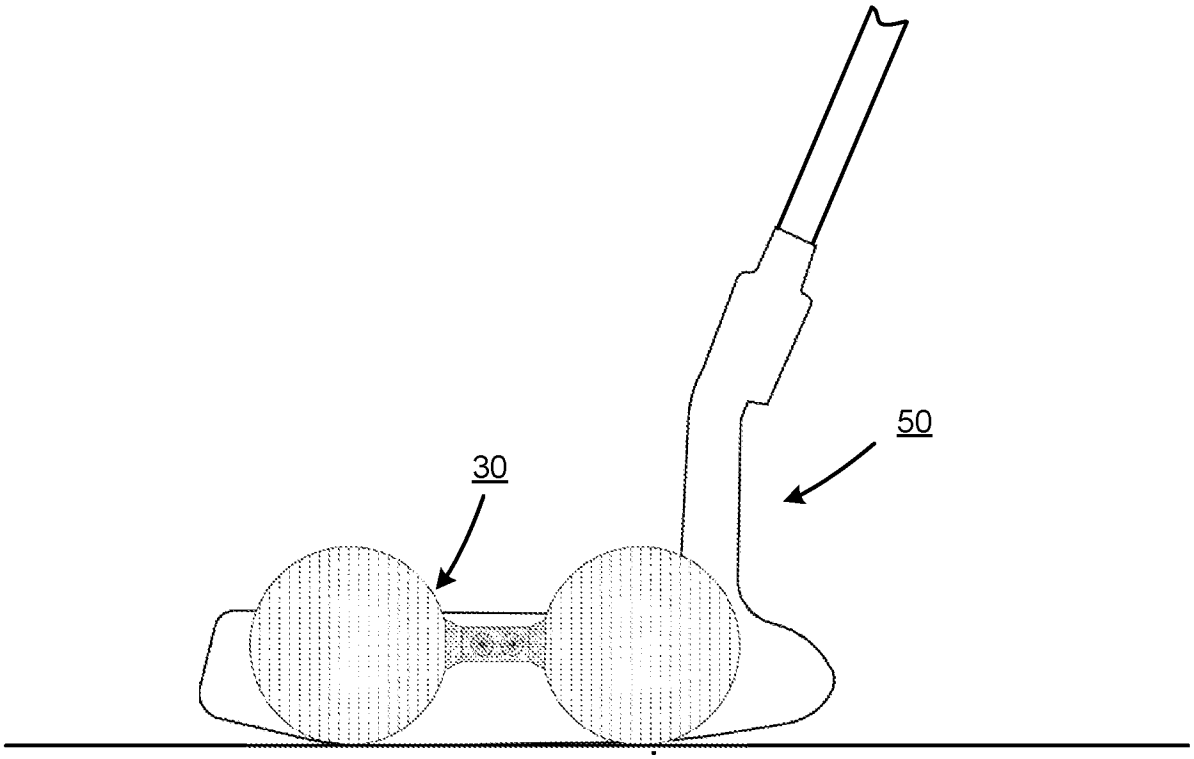
FIG. 20 illustrates a golf putter at an address position while using the enhanced golf putting aid device, according to an embodiment.

FIG. 20 illustrates a golf putter 50 at an address position while using the enhanced golf putting aid device 30, according to an embodiment. In practice, the golfer may train with the enhanced golf putting aid 30 by applying natural golf putting strokes to the putter aid 30. In practice, the enhanced putting training aid 30 may provide visual and audio feedback to the golfer when the putter aid 30 is properly or improperly struck, allowing the golfer a means by which they may learn and improve their putting strokes. For example, the putter aid 30 may activate and illuminate a first colored light from the LED lights 100-3*f* and/or generate a positive sound effect from the speaker 100-3*g* when the putting training aid 30 is squarely and properly struck by the golf putter 50 upon impact, causing the putting training aid 30 to roll along a straight path. Conversely, the putter aid 30 may activate and illuminate a second colored light from the LED lights 100-3*f* and/or generate a negative sound effect from the speaker 100-3*g* when the putting training aid 30 is not squarely struck by the golf putter 50 upon impact, causing the putting training aid 30 to veer off the straight path. The visual and audio feedback may include many positive and negative feedback responses including, but not limited to, a green light, solid light, chiming sounds, and or voice generated success phrases (e.g., "Yay!", "Great job!", "You got this!") when the putting training aid 30 is properly struck by the golf putter 50 upon impact, and a red light, flashing light, siren sound, and or voice generated negative phrases (e.g., "Wawawa!", "Awwwe!", "Try again!") when the putting training aid 30 is incorrectly struck by the golf putter 50 upon impact.

In sum, the golf putting aid making tool (100 or 200) offer many advantages to golfers including, convenience, portability, and ease of use for quickly making and reliably assembling putter training aids using readily available golf equipment.

All patents, patent applications, and other references cited herein are incorporated by reference in their entireties.

The singular forms "a", "an", and "the" included plural referents unless the context clearly dictates otherwise, as applied in the specification and the appended claims.

It is noted that the disclosure provide herein has been provided merely for the purpose of explanation and is in no way to be construed as limiting of the present disclosure. Although the present disclosure has been shown and described with respect to several preferred embodiments thereof, various changes, omissions, and additions to the form and detail thereof, may be made therein, without departing from the spirit and scope of the disclosure. It is understood that the words which have been used herein are words of description and illustration, rather than words of limitation. Changes may be made, within the purview of the appended claims, as presently stated and as amended, without departing from the scope and spirit of the present disclosure in its aspects.

Other implementations and modifications of the present disclosure may occur to those of ordinary skill in the art in view of these teachings in the specification and drawings. Accordingly, the disclosure is to be limited only by the following claims which include all other such embodiments and modifications when viewed in conjunction with the above specifications and accompanying figures.

What is claimed is:

1. A golf putting aid making tool comprising:

a retaining member for receiving two golf balls;

a connector; and a connector stand coupled to the retaining member and centrally disposed along a lengthwise section of the golf putting aid making tool, wherein the connector stand receives and supports the connector for coupling the two golf balls along a center portion of the two golf balls, wherein the connector includes a shaft member coupling a first end cap to a second end cap.

2. The golf putting aid making tool of claim 1, wherein the retaining member includes two golf ball recessed slots disposed along a top portion of the retaining member.

3. The golf putting aid making tool of claim 2, wherein the connector stand is disposed between the two golf ball recessed slots which are separated by a gap.

4. The golf putting aid making tool of claim 3, wherein each of the two golf ball recessed slot is a cut-out of a spherical cap removed from a portion of the retaining member.

5. The golf putting aid making tool of claim 1, wherein the shaft member is separated into a first shaft section and a second shaft section, wherein a threaded member is disposed at an exposed end of the first shaft section, and a threaded slot member is disposed at an exposed end of the second shaft section.

6. The golf putting aid making tool of claim 1, wherein the first end cap and the second end cap have magnetic properties.

7. The golf putting aid making tool of claim 1, wherein a first golf ball coupling member is applied to an outer side portion of the first end cap and a second golf ball coupling member is applied to an outer side portion of the second end cap.

8. The golf putting aid making tool of claim 7, wherein the each golf ball coupling member includes a substrate having two-sided adhesive properties or a substrate having magnetic properties.

9. The golf putting aid making tool of claim 1, wherein the connector stand includes a block member having a stand depression formed along a top portion of the block member.

10. The golf putting aid making tool of claim 9, wherein the stand depression is configured to receive and support a portion of the shaft member of the connector having shape that is complementary to the stand depression.

11. The golf putting aid making tool of claim 1, further comprising: a slider rail assembly coupled to the retaining member, wherein the retaining member includes two adjustable sliding members.

12. The golf putting aid making tool of claim 11, wherein the slider rail assembly includes two cylindrical rods and a stand support bar extending lengthwise from a first sliding end to a second sliding end.

13. The golf putting aid making tool of claim 12, wherein the connector stand is disposed along a lengthwise center line of the stand support bar.

14. The golf putting aid making tool of claim 12, wherein the two adjustable sliding members are coupled by the slider rail assembly and configured to slide horizontally along a lengthwise section of the slider rail assembly.

15. The golf putting aid making tool of claim 12, wherein each adjustable sliding member includes a pair of holes extending through the adjustable sliding member for receiving the two cylindrical rods when inserted therein.

16. The golf putting aid making tool of claim 12, wherein each adjustable sliding member includes a bar slot extending through the adjustable sliding member for receiving the stand support bar when inserted therein.

17. The golf putting aid making tool of claim 12, wherein a golf ball recessed slot is disposed along an inner side of each adjustable sliding member for holding and retaining the two golf balls when inserted therein.

18. The golf putting aid making tool of claim 1, wherein the connector includes a plurality of electrical components integrated into a shaft member of the connector, wherein the plurality of electrical components includes at least an illumination device and an audio device.

19. The golf putting aid making tool of claim 1, wherein the connector and the two golf balls are assembled into a single unit by the golf putting aid making tool to form an ad hoc golf putting aid device.

* * * * *